US007578709B2

(12) United States Patent
Daudin et al.

(10) Patent No.: US 7,578,709 B2
(45) Date of Patent: Aug. 25, 2009

(54) CONTACT LOCKING DEVICE FOR AN ELECTRIC CONNECTOR AND ELECTRIC CONNECTOR CONTAINING SAID DEVICE

(75) Inventors: Philippe Daudin, Pierres (FR); Gilles Schmitt, Senantes (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/583,287

(22) PCT Filed: Nov. 30, 2004

(86) PCT No.: PCT/EP2004/013653

§ 371 (c)(1),
(2), (4) Date: Jun. 16, 2006

(87) PCT Pub. No.: WO2005/069686

PCT Pub. Date: Jul. 28, 2005

(65) Prior Publication Data

US 2007/0155254 A1 Jul. 5, 2007

(30) Foreign Application Priority Data

Dec. 19, 2003 (FR) ..... 03 15047

(51) Int. Cl.
*H01R 13/514* (2006.01)

(52) U.S. Cl. ..... 439/752
(58) Field of Classification Search ..... 439/595, 439/752
See application file for complete search history.

(56) References Cited

U.S. PATENT DOCUMENTS 5,575,685 A * 11/1996 Ittah et al. ..... 439/595
5,931,700 A 8/1999 Saito et al. ..... 439/595

FOREIGN PATENT DOCUMENTS

EP 1 276 175 A1 1/2003

* cited by examiner

*Primary Examiner*—Phuong K Dinh
(74) *Attorney, Agent, or Firm*—Harrington & Smith, PC

(57) ABSTRACT

The invention relates to an electric connector element including a housing receiving first and second contacts; a first locking device for the first contacts, which can move between a release position and a locking position for the first contacts; a second locking device for the second contacts, which can move between a release position and a locking position for the second contacts; also including means for preventing maneuvering of the second locking device when the first locking device is not in a locking position for the first contacts.

19 Claims, 3 Drawing Sheets

CONTACT LOCKING DEVICE FOR AN ELECTRIC CONNECTOR AND ELECTRIC CONNECTOR CONTAINING SAID DEVICE

FIELD OF THE INVENTION

The present invention concerns a contact locking device for an electric connector.

BACKGROUND

It is known particularly within the scope of automobile connector technology to provide insulating housings bearing contacts provided with systems for locking electrical contacts by latching with the contacts or with primary retaining components for the contacts.

These locking systems can be primary locking systems when they assure latching and holding of the contact in a connector socket or secondary locking systems when they supplement a first locking means and introduce additional locking security or additional resistance to pulling the contact out from the socket.

Locking devices must provide an additional security, i.e., the detection of poorly inserted or poorly latched contacts, and, in particular, must prevent the coupling of complementary connectors when the contacts are poorly inserted and/or when the locking device is not locked.

The present invention seeks to improve devices for locking electrical contacts in connector housings and notably proposes a device for locking contacts in a contact-holder housing with different locking devices, the locking device being additionally required to permit the detection of poorly latched contacts.

To do this, the invention principally concerns an electric connector element comprising a housing for receiving first and second contacts, provided with a first locking device for the first contacts, which can move between a release position and a locking position of said first contacts, a second locking device for the second contacts which can move between a release position and a locking position of said second contacts, the electric connector element comprising means for preventing maneuvering of the second locking device when the first locking device is not in the locked position for the first contacts.

The connector element can notably be designed such that the first device for locking and holding the first contacts bears a rotary flap with digits crosswise to a direction of insertion of the first contacts in the housing, while the second locking device comprises a front grid provided with elements for holding the second contacts directed toward the rear.

In a particular embodiment, the prevention means can comprise at least one stop element, made one piece with the housing, positioned in the path of an arm that is part of the second locking device and which opposes a maneuvering of the second locking device from the release position to the locking position for the second contacts.

The arm can advantageously be a flexible arm equipped with a spur provided with a first profile for interlocking with a complementary profile of the stop element and a second profile forming a profile that provides release by sliding against the stop element after the arm is bent.

The first locking device, in the locking position for the contacts, may comprise a shoulder which is positioned at least partially in front of the stop element or positioned in front of at least one part of the stop element and which permit the maneuvering of the second locking device towards its locking position by bending the arm.

According to one advantageous embodiment of the invention, the arm and the stop element comprise inclined rear surfaces so that once the grid is in the set-back position for locking the second contacts, the arm and the stop element hold the grid in the set-back position by cooperation of the rear inclined surface of the arm and the rear inclined surface of the stop element.

Advantageously, the second locking device, in locking position, comprises an element for preventing a maneuvering of the first locking device from its locking position to its release position for the first contacts.

The device for preventing maneuvering can notably be made up of a piece borne by the second locking device and received in a housing that is part of the first locking device.

The housing can notably be part of an elastic latching element.

Other characteristics and advantages of the invention will be better understood upon reading the description that follows of one non-limiting example of embodiment of the invention in reference to the Figures, which show:

DETAIL DESCRIPTION

Figure 1A:
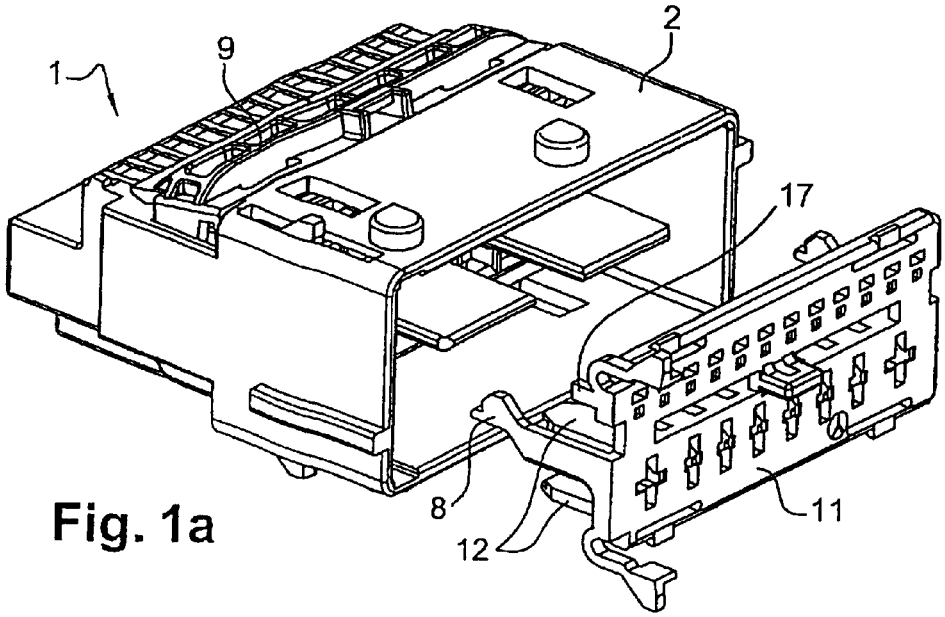
In FIGS. 1*a* and 1*b*: perspective views of a connector element according to the invention.
Figure 1B:
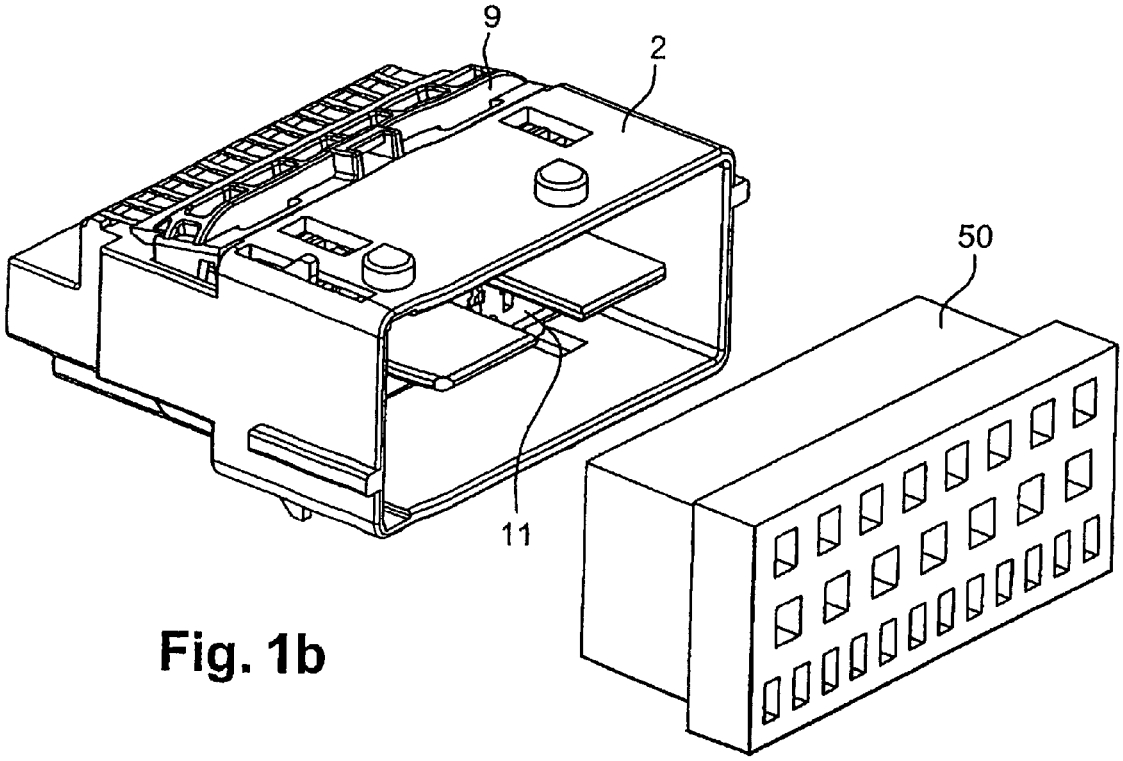

FIG. 1*a* shows an electric connector element 1 provided with a grid 11 for re-positioning and locking the contact terminals. FIG. 1*b* shows the connector element facing a complementary connector element.

Figure 2:
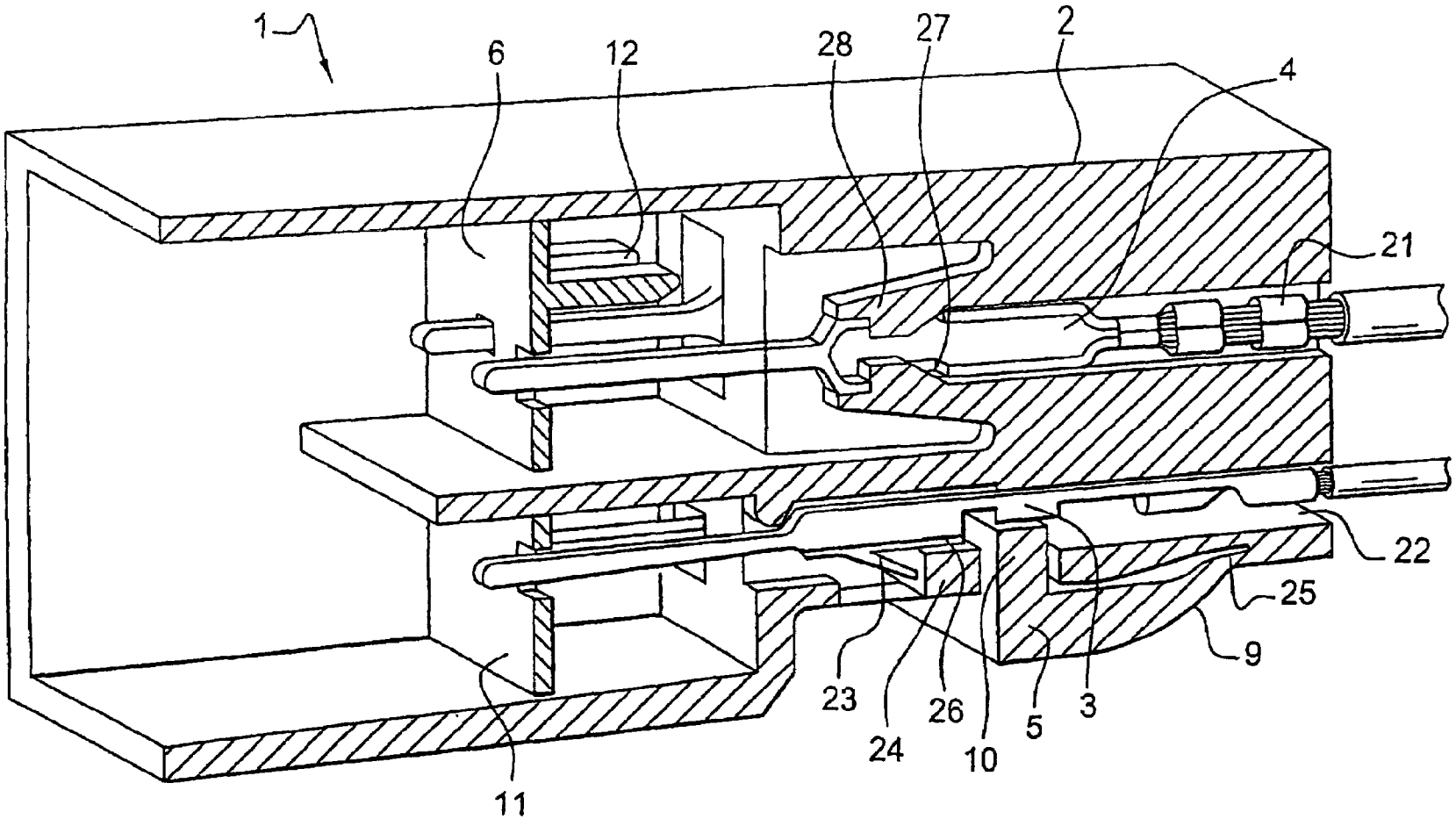
In FIG. 2: a view in perspective section along a receiving recess for contacting the connector element of FIG. 1*a;*

The electric connector element 1 shown in section in FIG. 2 comprises a housing 2 provided with sockets 21, 22 for receiving first contacts 3 and second contacts 4. The first contacts 3, according to the example, are contacts provided with a metal locking projection 23 abutting a partition 24 of the housing and holding contact 3 in the direction of its extraction from the housing.

The housing is provided with a first device 5 for locking first contacts 3. This first locking device, according to the example, is in the form of a rotary flap 9, connected to the housing by a hinge 25, and can be moved between a release position and a locking position for said first contacts 3. To lock the first contacts 3, the flap is provided with digits 10 for holding and locking the first contacts in sockets 22, crosswise to the direction of insertion for the first contacts 3 in the housing, and resting against a shoulder 26 of contacts 3.

The housing receives second contacts 4, which here are contacts comprising slits 27 into which locking tabs 28 are latched, holding the second contacts 4 in the direction of extraction of these contacts from the housing.

According to the example shown, the first and second contacts are terminal contacts.

According to the invention, connector element 1 has a second locking device 6 for second contacts 4, which can move between a release position and a locking position for said second contacts 4.

This second locking and retaining device for second contacts 4 is made up of elements 12 in the form of shafts directed towards the rear and designed to interlock with tabs 28 to lock the second contacts. The shafts are joined to a front grid 11 through which pass the points of contact terminals 3, 4; the grid can move between a forward position for protection of the points and release of the tabs and a set-back position that uncovers the contact terminal points and, for which, retaining elements 12 that form the shafts interlock with tabs 28 and thus lock second contacts 4.

The object of the locking device of the invention is to assure correct locking of the contacts.

Particularly in applications for automobile connectors, it is desired that any poor insertion of the contact is detected during the wiring of the vehicle. Thus, in a known manner, grid 11 is made so that if one of the contacts that it must lock is only partially inserted in its socket, shaft 12 abuts against corresponding tab 28 which prevents the backward movement of the grid.

Likewise, in the case where a first contact 3 is only partially inserted, flap 9 cannot be pushed into locking position.

According to the invention, an additional security is provided, which does not allow backward movement of grid 11 into the locking position for the second contacts unless flap 9 is itself in the locking position.

Thus the invention provides means 7, 8 for preventing the maneuvering of second locking device 6, which are made up of pieces 10 of flap 9, when first locking device 5 made up of shafts 12 of grid 11 is not in locking position for first contacts 3.

Figure 3A:
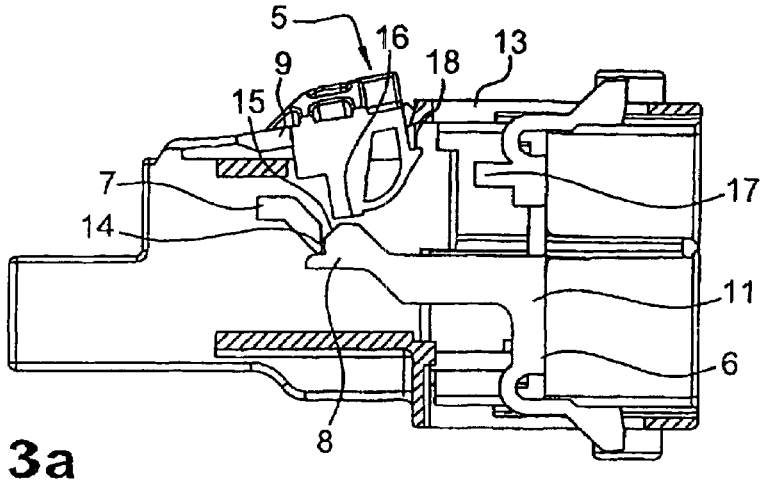
In FIGS. 3*a*, 3*b* and 3*c*: sectional views of the connector element of FIG. 1*a* showing a locking device according to the invention.
Figure 3B:
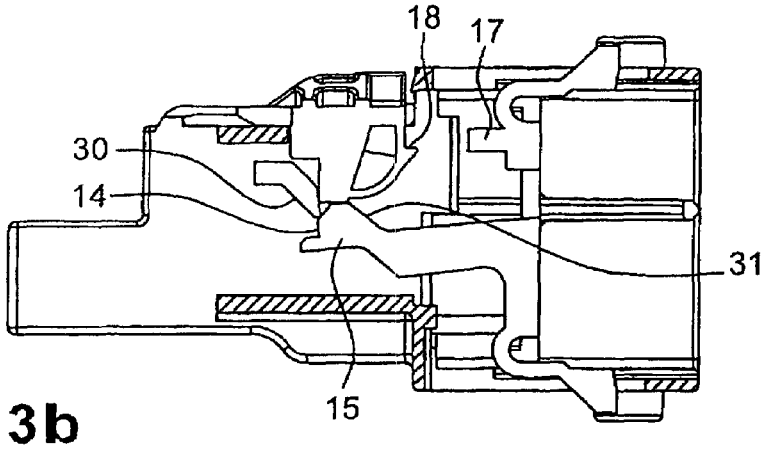
Figure 3C:
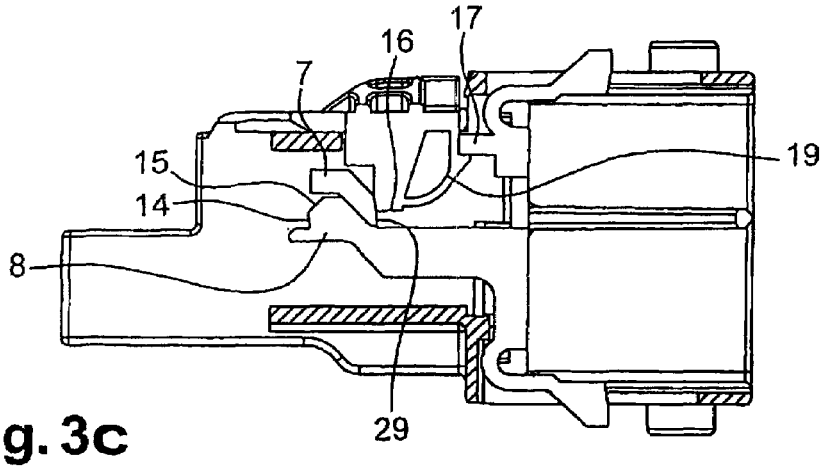

The means for preventing maneuvering shown in FIGS. 3*a*, 3*b*, 3*c* comprise, on one hand, at least one stop element 7 made in housing 2 and on the other hand, an arm 8 joined to grid 11 and directed toward the rear of the grid along the axis of sockets 21, 22. The stop element is positioned in the path of arm 8 and opposes the maneuvering of second locking device 6, from the release position toward the locking position for second contacts 4, by preventing the backward movement of the grid. To do this, arm 8 and the stop element comprise profiles 14, 29 facing and parallel to one another and perpendicular to the direction of movement of grid 11.

In order to permit backward movement of the grid, it is necessary for profile 14 of arm 8 to be displaced and moved away from profile 29 of the stop element.

According to the example, arm 8 is flexible and provided with a spur 13 provided on first profile 14 for interlocking with complementary profile 29 of the stop element. As shown in FIG. 3*b*, first locking device 5 comprises for its part a shoulder 16 which, when first locking device 5 is in the locking position for first contacts 3, is positioned in front of at least a part of stop element 7 and presses the arm in a direction perpendicular to the direction of maneuvering of grid 11. Thus, shoulder 16 displaces profile 14 and pushes away the stop element.

In order to permit movement of second locking device 6 towards its locking position, the profile for interlocking on spur 13 is followed by an inclined profile 15 which, when arm 8 is bent and pushed by shoulder 16, can slide against stop element 7.

Once grid 11 is in its set back position for locking second contacts 4, as shown in FIG. 3*c*, arm 8 again takes its position parallel to the axis of the sockets and pulls the grid into its set back position by cooperation with a rear inclined surface 31 of spur 13 and a rear inclined surface 30 of stop element 7.

According to the invention, grid 11 can only be locked when the flap is in its locking position.

Once the two locking devices are correctly positioned, the invention only allows unlocking of the first device when the second device is itself unlocked. To do this, the grid comprising second locking device 6, in locking position, is provided with an element for preventing the maneuvering of first locking device 5 from its locking position toward its release position for first contacts 3.

This element preventing maneuvering is made up, according to the example, of a piece 17 borne by grid 11 and received in a recess 18 making up part of flap 9 comprising first locking device 5.

Thus, in order to move flap 9 from its locking position to its unlocked position, it is necessary first to return grid 11 to the forward position, which offers additional locking security for the contacts since the flap can only be opened when connector element 1 is coupled to a complementary connector 50 such as shown in FIG. 1*a** and the grid is in the set-back position.

*sic; FIG. 1*b*?—Trans. Note.

According to FIGS. 3*a*, 3*b*, 3*c*, recess 18 makes up a part of an elastic latching element 19 assuring an effective retention of the flap.

The invention is not limited to the example described and can notably be used for a connector element receiving female contacts or comprising locking devices acting in other directions.

The invention claimed is:

1. An electric connector element comprising a housing for receiving first and second contacts, a first locking device adapted to lock only the first contacts with the housing, which can move between a release position and a locking position for said first contacts, a second locking device adapted to lock only the second contacts with the housing, which can move between a release position and a locking position for said second contacts, characterized in that the electric connector element comprises means for preventing a maneuvering of the second locking device when the first locking device is not in the locking position for first contacts.

2. The electrical connector element according to claim 1, further characterized in that the first locking device comprises a rotary flap provided with digits for holding the first contacts, crosswise to a direction of insertion of the first contacts in the housing, and the second locking device comprising a front grid provided with elements for holding the second contacts, directed towards the rear.

3. The electric connector element according to claim 1, further characterized in that the prevention means comprise at least one stop element, joined to the housing, positioned in a path of an arm which is part of the second locking device and which opposes the maneuvering of the second locking device from the release position towards the locking position for the second contacts.

4. The electric connector element according to claim 3, further characterized in that the arm is flexible and equipped with a spur provided with a first profile for interlocking with a complementary profile of the stop element and a second profile forming, after the arm is bent, a profile for release by sliding against the stop element.

5. The electric connector element according to claim 3, further characterized in that first locking device comprises a shoulder which is positioned in front of at least a part of the stop element and permits maneuvering the second locking device towards its locking position by bending the arm, when the first locking device is in the locking position for first contacts.

6. The electric connector element according to claim 3, further characterized in that the arm and the stop element comprise rear inclined surfaces such that once a grid of the second locking device is in its set-back position for locking the second contacts, the arm and the stop element hold the grid in the set-back position by cooperation of the rear inclined surface of the arm with the rear inclined surface of the stop element.

7. The electric connector element according to claim 1, further characterized in that the second locking device, in the locking position, comprises an element for preventing the maneuvering of the first locking device from its locking position toward its release position for the first contacts.

8. The electric connector element according to claim 7, further characterized in that said element for preventing maneuvering is made up of a piece borne by the second locking device and received in a recess that is part of the first locking device.

9. The electric connector element according to claim 8, further characterized in that the recess makes up a part of the elastic latching element.

10. An electric connector element comprising:

a housing which is sized and shaped to receive first contacts and different second contacts, wherein the second contacts have a different shape than the first contacts;

a first locking device configured to directly lock the first contacts with the housing, wherein the first locking device is connected to the housing to move between a release position and a locking position for the first contacts; and a second locking device configured to indirectly lock the second contacts with the housing, wherein the second locking device is connected to the housing to move between a release position and a locking position for the second contacts, wherein the electric connector element comprises a system for preventing the second locking device from moving from the release position to the locking position for the second contacts when the first locking device is not in the locking position for first contacts, wherein the system for preventing comprises at least one stop element, joined to the housing, positioned in a path of an arm which is part of the second locking device and which opposes the maneuvering of the second locking device from the release position towards the locking position for the second contacts.

11. The electrical connector element according to claim 10, further characterized in that the first locking device comprises a rotary flap provided with digits for holding the first contacts, crosswise to a direction of insertion of the first contacts in the housing, and the second locking device comprising a front grid provided with elements for holding the second contacts, directed towards the rear.

12. The electric connector element according to claim 10, further characterized in that the arm is flexible and equipped with a spur provided with a first profile for interlocking with a complementary profile of the stop element and a second profile forming, after the arm is bent, a profile for release by sliding against the stop element.

13. The electric connector element according to claim 10, further characterized in that first locking device comprises a shoulder which is positioned in front of at least a part of the stop element and permits maneuvering the second locking device towards its locking position by bending the arm, when the first locking device is in the locking position for first contacts.

14. The electric connector element according to claim 10, further characterized in that the arm and the stop element comprise rear inclined surfaces such that once a grid of the second locking device is in a set-back position for locking the second contacts, the arm and the stop element hold the grid in the set-back position by cooperation of the rear inclined surface of the arm with the rear inclined surface of the stop element.

15. The electric connector element according to claim 10, further characterized in that the second locking device, in the locking position, comprises an element for preventing the maneuvering of the first locking device from its locking position toward its release position for the first contacts, wherein the element for preventing maneuvering is made up of a piece borne by the second locking device and received in a recess that is part of the first locking device.

16. The electric connector element according to claim 15, further characterized in that the recess makes up a part of the elastic latching element.

17. An electric connector element comprising:

a housing which is sized and shaped to receive first contacts and different second contacts;

a first locking device for the first contacts, wherein the first locking device is connected to the housing to move between a release position and a locking position for the first contacts; and a second locking device for the second contacts, wherein the second locking device is connected to the housing to move between a release position and a locking position for the second contacts, wherein the electric connector element comprises a system for preventing the second locking device from moving from the release position to the locking position for the second contacts unless the first locking device is in the locking position for first contacts, and wherein the preventing system comprises at least one stop element, joined to the housing, positioned in a path of an arm which is part of the second locking device and which opposes the maneuvering of the second locking device from the release position towards the locking position for the second contacts.

18. An electric connector element comprising:

a housing which is sized and shaped to receive first contacts and differently shaped second contacts;

a first locking device configured to lock the first contacts with the housing, wherein the first locking device is connected to the housing to move between a release position and a locking position for the first contacts; and a second locking device configured to lock the second contacts with the housing, wherein the second locking device is connected to the housing to move between a release position and a locking position for the second contacts, wherein the electric connector element comprises a system for preventing the second locking device from moving from the release position to the locking position for the second contacts when the first locking device is not in the locking position for first contacts, wherein the system for preventing the second locking device from moving comprises a portion spaced from the first locking device when the first locking device is in the release position, wherein the portion is configured to contact the second locking device to prevent the second locking device from moving from the release position to the locking position, and wherein the second locking device, when in the locking position, comprises a portion for preventing movement of the first locking device from its locking position toward its release position for the first contacts, wherein the portion is received in a recess of the first locking device.

19. An electric connector element comprising:

a housing which is sized and shaped to receive first contacts and second contacts, wherein the housing comprises resiliently deflectable locking tabs adapted to lock the second contacts to the housing;

a first locking device configured to lock the first contacts with the housing, wherein the first locking device is connected to the housing to move between a release position and a locking position for the first contacts; and a second locking device configured to lock the locking tabs with the housing, wherein the second locking device is connected to the housing to move between a release position and a locking position for the second contacts, and wherein in the locking position the second locking device prevents the locking tabs from disengaging with the second contacts, wherein the electric connector element comprises a system for preventing the second locking device from moving from the release position to the locking position for the second contacts when the first locking device is not in the locking position for first contacts, wherein the system for preventing the second locking device from moving comprises a portion spaced from the first locking device when the first locking device is in the release position.

* * * * *